US012806479B2

(12) United States Patent
Caliandro

(10) Patent No.: US 12,806,479 B2
(45) Date of Patent: Nov. 24, 2026

(54) TREE CLIMBING GLOVES

(71) Applicant: Treekour, Wolfeboro, NH (US)

(72) Inventor: Paul Caliandro, Wolfeboro, NH (US)

(73) Assignee: TREEKOUR, Wolfeboro, NH (US)

( * ) Notice: Subject to any disclaimer, the term of this patent is extended or adjusted under 35 U.S.C. 154(b) by 0 days.

(21) Appl. No.: 19/207,086

(22) Filed: May 13, 2025

(65) Prior Publication Data

US 2025/0352858 A1 Nov. 20, 2025

Related U.S. Application Data

(60) Provisional application No. 63/648,550, filed on May 16, 2024.

(51) Int. Cl.
*A63B 27/00* (2006.01)
*A41D 19/015* (2006.01)

(52) U.S. Cl.
CPC ..... *A63B 27/00* (2013.01); *A41D 19/01547* (2013.01); *A41D 2400/80* (2013.01)

(58) Field of Classification Search
CPC ..... A41D 19/0024; A41D 19/01594; A41D 19/01547; A41D 19/0086; A63B 27/02; A43B 5/003
USPC ..... 36/113
See application file for complete search history.

(56) References Cited

U.S. PATENT DOCUMENTS 183,375 A * 10/1876 Cutliff ..... A41D 19/01547 172/370
883,761 A * 4/1908 Taylor ..... A61F 13/105 2/21
3,787,898 A * 1/1974 Walker ..... A41D 19/01547 2/163
4,875,550 A * 10/1989 Rullo ..... A63B 27/00 182/221
6,035,444 A * 3/2000 McGrew ..... A41F 1/06 2/161.8
7,971,271 B2 7/2011 Raghuprasad
2015/0366228 A1* 12/2015 Lugo ..... B26B 27/007 30/172
2020/0000174 A1 1/2020 Plance et al.

FOREIGN PATENT DOCUMENTS

CN 2416761 Y 1/2001
CN 101870100 10/2010
CN 103340482 10/2013
CN 106858850 A 6/2017
(Continued)

OTHER PUBLICATIONS

Translation of CN-106901422-A (Year: 2017).*
(Continued)

*Primary Examiner* — Grady Alexander Nunnery
(74) *Attorney, Agent, or Firm* — Foley & Lardner LLP

(57) ABSTRACT

A climbing glove includes a palm portion and a plurality of digit portions arranged adjacent to the palm portion. Each of the plurality of digit portions includes at least one protruding element, the protruding element configured to engage with a surface of a tree, and where each of the plurality of protruding elements is configured to extend from an outermost surface of the glove at an angle less than 90 degrees, and where each of the plurality of protruding elements has a tetrahedral shape.

18 Claims, 2 Drawing Sheets

(56) References Cited

FOREIGN PATENT DOCUMENTS

| | | | | |
|---|---|---|---|---|
| CN | 106901422 A | * | 6/2017 | ..... A41D 19/015 |
| FR | 2567373 A1 | * | 1/1986 | ..... A41D 19/01505 |

OTHER PUBLICATIONS

Translation of FR-2567373-A1 (Year: 1986).*
⅘ Hand Claw BS Plastic Garden Rubber Gloves With Claws Gardening Digging Planting Waterproof Work Glove Outdoor Gadgets Tools, Aug. 30, 2023, URL: https://www.google.com/imgres?imgurl=https%3A%2F%2Falitools.io%2Fen%2Fshowcase%2Fimage%3Furl%3Dhttps%253A%252F%252Fae01.alicdn.com%252Fkf%252FH1b18944073084aef87be97225ad1972dT.jpg&tbnid=aDUeEf4S5wpuPM&vet=12ahUKEwilxPLNoYCBAxVhLN4AHVzIA5gQMyhAegUIARCCAw..i&imgrefurl=https%3A%2F%2Falitools.io%2Fen%2Fshowcase%2F4-8-hand-claw-bs-plastic-garden-rubber-glov.
BladesUSA 2801 Ninja Climbing Claw Sold As Pair, Jun. 18, 2012, amazon.ca, Aug. 30, 2023, URL: https://www.amazon.ca/BladesUSA-2801-Ninja-Climbing-Claw/dp/B0060C8GVM.
Chargenyang 2 Pairs Garden Gloves, Garden Gloves with Claws for Women and Men Both Hands Gardening Work Gloves Quick & Easy to Dig & Plant, Safe Gloves for Women & Men, Apr. 6, 2022, amazon.ca, Aug. 30, 2023, URL: https://www.amazon.ca/Chargenyang-Pairs-Garden-Gloves-Gardening/dp/B09XCZNBH8/ref=sr_1_6?crid=1CQ8YUVSRWQST&keywords=gloves claw utility&qid=1693256898&sprefix=gloves claw utilit%2Caps%2C125&sr=8-6.
International Search Report and Written Opinion for PCT/U82025/029165 mailed Sep. 26, 2025.

* cited by examiner

TREE CLIMBING GLOVES

CROSS-REFERENCE TO RELATED APPLICATIONS

This application claims the benefit of and priority to U.S. Provisional Application No. 63/648,550, filed on May 16, 2024, the entire disclosure of which is hereby incorporated by reference herein.

TECHNICAL FIELD

The present disclosure relates to gloves structured for use in tree climbing.

BACKGROUND

Tree climbing often requires significant physical strength and skill to navigate due to branch structure, grade, height, and other factors. Although some tree climbers implement various tools and techniques to facilitate climbing, it would be advantageous to provide gloves to enhance grip and increase safety while climbing.

SUMMARY

At least one aspect of the present disclosure relates to a climbing glove. The climbing glove includes a palm portion and a plurality of digit portions arranged adjacent to the palm portion. Each of the plurality of digit portions includes at least one protruding element, the protruding element configured to engage with a surface of a tree, where each of the plurality of protruding elements is configured to extend from an outermost surface of the glove at an angle less than 90 degrees, and where each of the plurality of protruding elements has a tetrahedral shape.

In various embodiments, each of the plurality of digit portions includes at least a proximal segment and a distal segment, each of the proximal segment and the distal segment having at least one of the plurality of protruding elements. In some embodiments, the plurality of digit portions includes four finger portions and a thumb portion. In other embodiments, each of the digit portions further includes a middle segment. In yet other embodiments, a width of each of the plurality of protruding elements is approximately equal to a length of each of the plurality of protruding elements. In various embodiments, a width of each of the plurality of protruding elements is approximately equal to one half the length of each of the plurality of protruding elements. In some embodiments, each of the plurality of protruding elements includes a first portion and a second portion, the first portion being disposed on a first surface of the glove and the second portion being disposed on a second surface of the glove, and where the first surface is outward facing and the second surface is inward facing. In other embodiments, the glove may include natural fibers. In yet other embodiments, the glove may include synthetic fibers. In various embodiments, the glove may further include a wrist portion structured to encircle a wrist of a climber. In some embodiments, the wrist portion includes an elastic cuff.

Another aspect of the present disclosure relates to a climbing glove. The climbing glove includes a palm portion and a plurality of digit portions integrally formed with the palm portion. Each of the plurality of digit portions includes a plurality of protruding elements distributed along each of the digit portions. Each of the plurality of protruding elements extends from an outermost surface of each digit portion at an angle and is structured to engage with a surface of a tree, the angle being an acute angle. At least one of a width or a length of each of the protruding elements is proportional to a corresponding at least one of a width or length of the corresponding digit portion.

In various embodiments, the width of each of the protruding elements is proportional to the width of the corresponding digit portion. In some embodiments, the length of each of the protruding elements is proportional the length of the corresponding digit portion. In other embodiments, the width of each of the protruding elements is greater than the length of each of the protruding elements. In yet other embodiments, each of the protruding elements is tetrahedral in shape. In various embodiments, the angle is based on a size of a section of the corresponding digit portion. In some embodiments, the plurality of digit portions include four finger portions and one thumb portion, each of the finger portions including three sections and the thumb portion including two sections. In other embodiments, each of the protruding elements includes a first portion and a second portion, the first portion being disposed on the outermost surface of the glove, the second portion being disposed on an inward facing surface of the glove, the first portion being coupled to the second portion. In some embodiments, the first portion and the second portion are integrally formed.

The foregoing summary is illustrative only and is not intended to be in any way limiting. In addition to the illustrative aspects, embodiments, and features described above, further aspects, embodiments, and features will become apparent by reference to the following drawings and the detailed description.

BRIEF DESCRIPTION OF THE DRAWINGS

A clear conception of the advantages and features constituting the present disclosure, and of the construction and operation of typical mechanisms provided with the present disclosure, will become more readily apparent by referring to the exemplary, and therefore non-limiting, embodiments illustrated in the drawings accompanying and forming a part of this specification, wherein like reference numerals designate the same elements in the several views, and in which.

DETAILED DESCRIPTION

Figure 2:
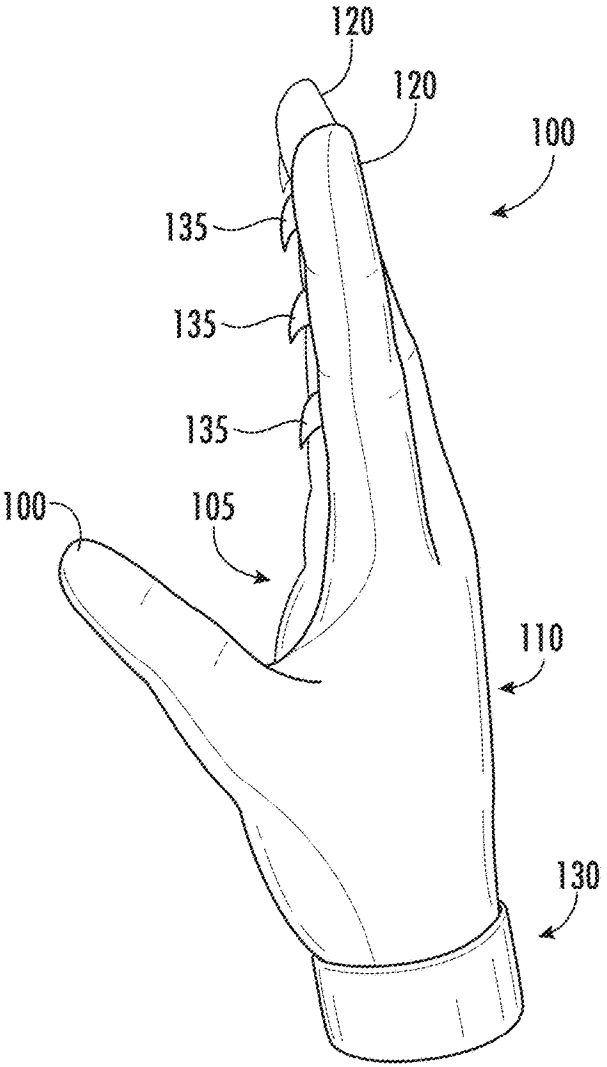
FIG. 2 is a side perspective view of a glove, according to at least one embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

As described above, tree climbing often requires significant strength, agility, and endurance as, depending on the climb, the branch structure, grade, and/or height of a tree can pose significant physical challenges and safety risks. In some instances, climbers can wear gloves to protect their hands and to increase grip, minimizing the risk of injuries. However, many glove designs can improve grip at the expense of tree health as some glove grip structures can cause damage to portions of the tree (e.g., outer bark, inner bark, cambium cell layer, sapwood, and/or heartwood). Accordingly, the present disclosure is directed to a specialized glove having features that enhance grip and increase climber safety while minimizing tree damage.

Figure 1:
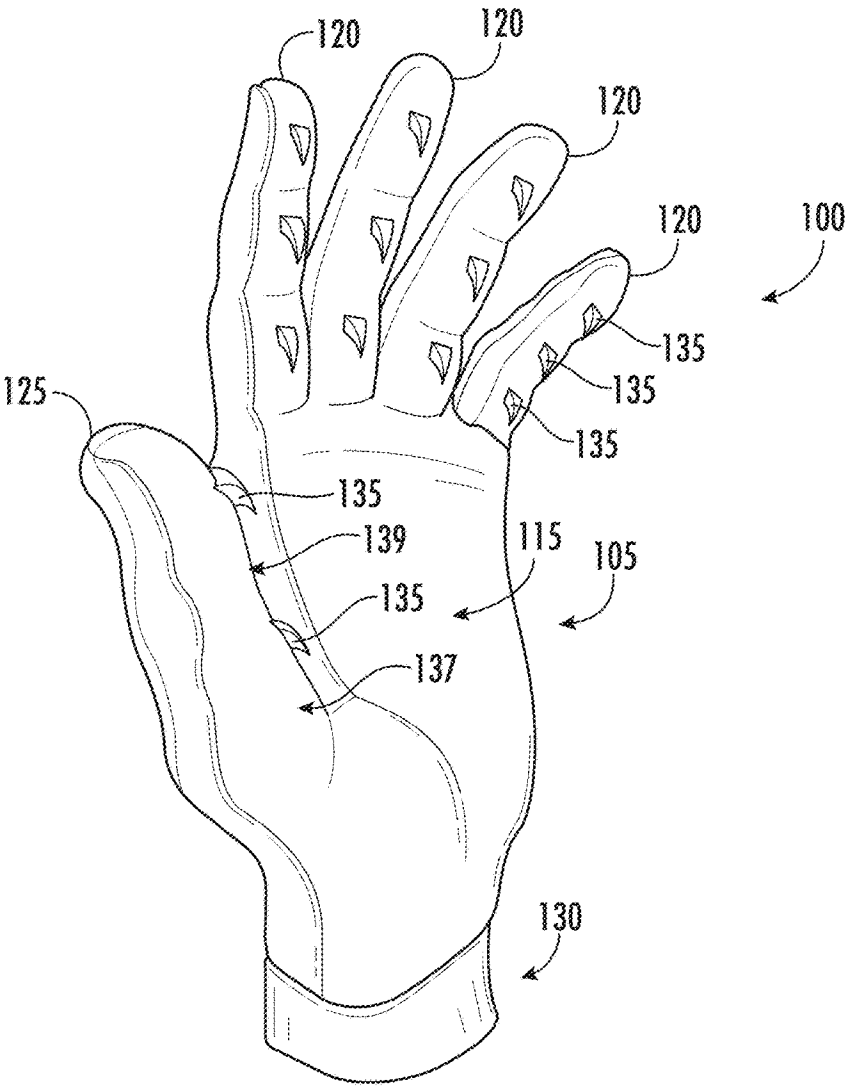
FIG. 1 is a front perspective view of a glove, according to at least one embodiment.

FIGS. 1 and 2 show front and side perspective views, respectively, of a glove 100 for use in tree climbing. As shown, the glove 100 includes a front side 105 and a back side 110, where a front side 105 is structured to engage with a portion of a tree (e.g., tree trunk) and the back side 110 is structured to face outward (e.g., toward the climber) when the glove 100 is worn by a climber. The glove includes a palm portion 115 disposed on the front side 105, which is structured to accommodate the palm of the climber. As shown, the palm portion 115 is disposed adjacent to five digit portions, where each of the five digit portions extend from the palm portion 115. In various embodiments, each digit portion is integrally formed with the palm portion 115. In other embodiments, at least one of the digit portions can be selectively removable from the palm portion 115. For example, in some embodiments, the digit portions can be selectively coupled (e.g., via hook and loop connections, magnets, snaps, tied knots, buttons, or any other suitable method known in the art) to the palm portion 115. In yet other embodiments, the digit portions can be separately worn from the palm portion 115.

The digit portions include four finger portions 120 and a thumb portion 125, to accommodate a climber's hand. As shown, the glove 100 includes four finger portions 120 to accommodate each of the index finger, middle finger, third finger, and little finger of the climber. The glove also includes the thumb portion 125, which is structured to accommodate the thumb of the climber. As shown in FIGS. 1-2, the glove 100 includes a wrist portion 130 which is disposed at a base of the palm portion 115 and structured to encircle the wrist of the climber.

In various embodiments, the glove 100 is formed from a flexible material, structured to elastically flex with movement of the climber's hand. In some embodiments, the glove 100 is formed from a fabric. In some embodiments, the fabric is natural (e.g., cotton, wool). In other embodiments, the fabric includes synthetic fibers (e.g., polyester, Kevlar, nylon, polyvinyl chloride, spandex, etc.). In yet other embodiments, the fabric of the glove 100 can include one or more types of fibers. In some embodiments, the glove 100 can include or be made from leather and/or leather equivalents. In various embodiments, the glove 100 can be made from water resistant material. In other embodiments, the glove 100 can be made from tear resistant material.

In some embodiments, the wrist portion 130 can include a cuff structured to retain the glove 100 on the hand of the climber. For example, in some embodiments, the wrist portion 130 can include a cuff having an elastic or neoprene cuff configured to surround the wrist of the climber to retain the glove 100 on the hand during climbing. In other embodiments, the wrist portion 130 can include one or more straps, strings, or other features structured to facilitate retention of the glove 100 on the hand of the climber.

As shown in FIGS. 1-2, the glove 100 can include a plurality of protruding elements 135 (e.g., spikes), which extend outward from the front side 105 of the glove 100. Each of the protruding elements 135 is structured to engage with a surface of the tree and enhance grip of glove 100 while in use by the climber. In some embodiments, the protruding elements 135 are disposed on the finger portions 120 and thumb portion 125, such as shown in FIGS. 1-2. In other embodiments, the protruding elements 135 can be disposed on the palm portion 115, or anywhere else on the front side 105 of the glove 100.

In some embodiments, the protruding elements 135 can be distributed along (i.e., along a length of) the thumb portion 125 and along each of the finger portions 120. As illustrated in FIG. 1, the thumb portion 125 can include two phalange sections: a proximal section 137 and a distal section 139. In some embodiments, the thumb portion 125 can be structured to include a singular protruding element 135 within each of the proximal section 137 and the distal section 139. In other embodiments, the thumb portion 125 can include multiple protruding elements 135 within each of the phalange sections.

Figure 3:
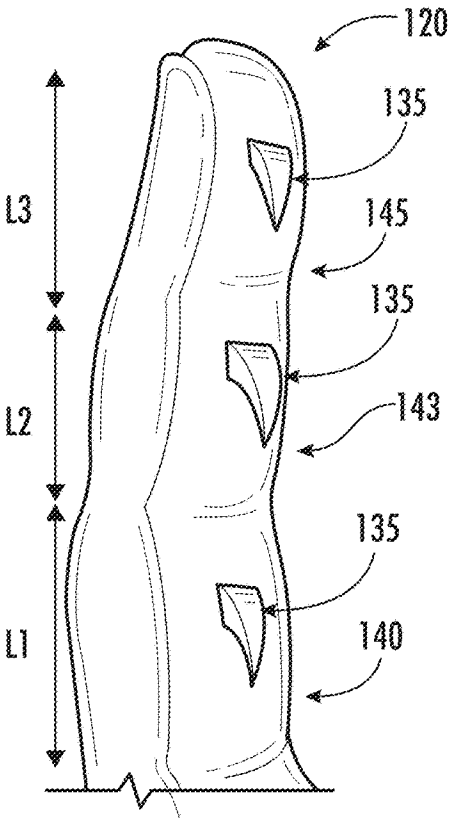
FIG. 3 is a side perspective view of a finger portion of the glove of FIG. 1, according to at least one embodiment.

As illustrated in FIG. 3, each of the finger portions 120 can include three phalange sections: a proximal phalange section 140, a middle phalange section 143, and a distal phalange section 145. In various embodiments, each of the finger portions 120 can be structured to include a singular protruding element 135 within each of the proximal phalange section 140, middle phalange section 143, and distal phalange section 145. In other embodiments, each of the proximal phalange section 140, middle phalange section 143, and distal phalange section 145 can include multiple protruding elements 135.

In various embodiments, the glove 100 can be structured to accommodate a range of climber hand sizes. As shown in FIG. 3, each segment of each finger portion 120 can be dimensioned to accommodate a specific size of a climber's hand. As shown, the proximal phalange section 140 can have a length L1, the middle phalange section 143 can have a length L2, and the distal phalange section 145 can have a length L3, which are each customizable based on a size of the climber's hand. In various embodiments, each of L1, L2, and L3 can correspond to specific length ranges. In some embodiments, the length ranges can be based on predetermined sizing designations, such as extra small, small, medium, large, extra large, etc. In some embodiments, a number of protruding elements 135 disposed within each of the proximal phalange section 140, middle phalange section 143, and distal phalange section 145 can be based on L1, L2, and/or L3, respectively. For example, in some embodiments, the number of protruding elements 135 disposed along the proximal phalange section 140 can increase with increasing L1. Similarly, the number of protruding elements 135 disposed along each of the middle phalange section 143 and distal phalange section 145 can increase with increasing L2 and L3, respectively.

In some embodiments, the distal phalange section 145 can include more protruding elements 135 as compared to the middle phalange section 143 and/or proximal phalange section 140. Similarly, in some embodiments, the distal phalange section 139 of the thumb portion 125 can include more protruding elements 135 as compared to the proximal section 137. In various embodiments, a number of protruding elements 135 within the glove 100 can be based on an intended use profile for the glove 100.

Figure 5:
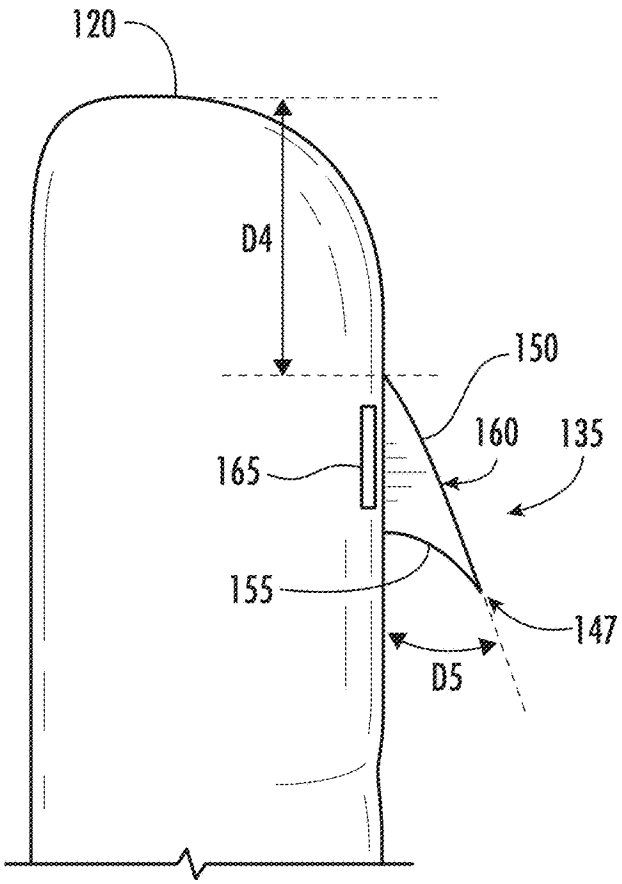
FIG. 5 is a side view of the finger portion of FIG. 4, according to at least one embodiment.
Figure 4:
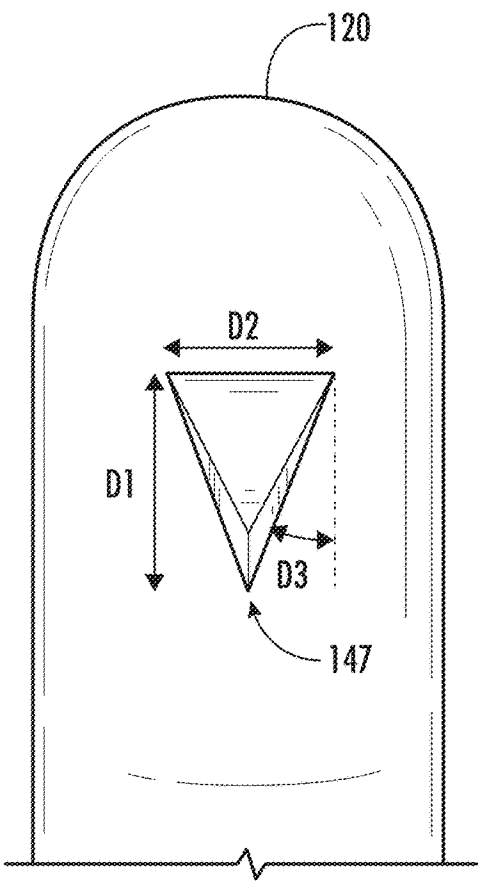
FIG. 4 is a front view of a segment of the finger portion of FIG. 3, according to at least one embodiment.

As shown in FIGS. 4 and 5, each of the protruding elements 135 can be structured to have a thorn shape. As shown in FIG. 4, each protruding element 135 can have a generally triangular or tetrahedral shape. In various embodiments, each protruding element 135 can be structured to have a particular length D1 and width D2 to facilitate grip enhancement. For example, in some embodiments, the glove 100 can be structured to facilitate climbing trees having a high grade and height, in which case both D1 and D2 can be increased. In other embodiments, the glove can be structured to facilitate climbing trees having a lower grade and height, in which case D2 can be larger than D1. In yet other embodiments, D1 can be significantly larger than D2 to accommodate a particular climbing environment. In various embodiments, the protruding elements 135 can be structured to transfer weight of the climber from the climber's chest to the climber's arms, which can facilitate improved grip endurance during climbing.

In some embodiments, D2 can be proportional to a width of the corresponding digit portion. For example, D2 can be proportional to a width of the finger portion 120. For example, in some embodiments, D2 is approximately half the width of the finger portion 120. In other embodiments, D2 is less than one third the width of the finger portion. Similarly, in some embodiments, D1 can be proportional to a length of each segment of the finger portion 120 (or similarly the thumb portion 125). For example, in some embodiments, D1 can be approximately equivalent to L1, L2, and/or L3. In other embodiments, D1 can be approximately half of L1, L2, and/or L3. In yet other embodiments, D1 can vary based on the segment of the finger portion 120. For example, in some embodiments, D1 of the protruding element 135 disposed on the distal segment 145 can be approximately ⅔ of L3, D1 of the protruding element 135 disposed on the middle segment 143 can be approximately ½ of D2, and D1 of the protruding element 135 disposed on the proximal segment 140 can be approximately ⅓ of D2. In other embodiments, D1 can have any length suitable for facilitating a climber to climb trees.

As shown in FIG. 3, each of the protruding elements 135 can have a generally triangular or tetrahedral shape such that an apex 147 of each of the protruding elements 135 is disposed at an angle D3 from a base portion (having a width D1) of the protruding element 135. In various embodiments, the angle D3 is based on a size of the glove 100. In other embodiments, the angle D3 is based on a size of a section of the corresponding digit portion. For example, in some embodiments, the angle D3 is based on a size of each of the proximal phalange section 140, middle phalange section 143, and distal phalange section 145 (or similarly based on the size of the proximal phalange section 137 and/or the distal phalange section 139). In some embodiments, the angle D3 can be less than 90 degrees (i.e., an acute angle). In other embodiments, the angle D3 greater than 90 degrees. In yet other embodiments, the angle D3 is greater than 45 degrees. In some embodiments, the angle D3 is less than 45 degrees.

In some embodiments, the glove 100 can be structured such that at least one protruding element 135 disposed within the distal phalange section 145 (or similarly the distal phalange section 139) is positioned a distance D4 from a tip of the corresponding finger portion 120. In some embodiments the distance D4 can correspond to approximately ½ of L3. In other embodiments, the distance D4 can correspond to ⅓ of L3. In yet other embodiments, D4 can be based on an overall size of the glove 100. In some embodiments, the distance D4 can be based on a particular use profile associated with the glove 100.

As shown in FIG. 5, each protruding element 135 can be structured to have a generally thorn shaped profile. For example, as illustrated in FIG. 5, each protruding element 135 can be structured such that a top surface 150 extends away from a surface of the glove 100 (within the finger portion 120) in a direction that can be oriented an angle D5 from the surface of the glove 100. In various embodiments, the angle D5 is less than 90 degrees. In some embodiments, the angle D5 is less than 45 degrees. In some embodiments, the angle D5 can be the same for each finger portion 120. In other embodiments, the angle D5 can be different for each finger portion 120. In some embodiments, the angle D5 can vary for each protruding element 135 based on whether the protruding element 135 is disposed within a proximal phalange section 140, a middle phalange section 143, and a distal phalange section 145. In other embodiments, the angle D5 is uniform for each of the proximal phalange section 140, middle phalange section 143, and distal phalange section 145. In some embodiments, the angle D5 is greater within each of the finger portions 120 as compared to the thumb portion 125. In other embodiments, the angle D5 is the same in each of the finger portions 120 and the thumb portion 125.

As shown in FIG. 5, a bottom surface 155 of each protruding element 135 is structured to extend from a surface of the glove 100 toward the apex 147. In some embodiments, an angle between the bottom surface 155 and the surface of the glove 100 is the same or approximately the same as D5. In other embodiments, the bottom surface 155 is curved, such as shown in FIG. 5, such that the bottom surface 155 forms a scoop shape to facilitate grip enhancement.

In some embodiments, each of the protruding elements 135 may include a first portion 160 and a second portion 165. As shown in FIG. 5, the first portion 160 can be disposed on a first, outward facing surface of the glove 100. The second portion 165 can be disposed on a second, inward facing surface of the glove 100. In various embodiments, the first portion 160 includes both of the top surface 150 and the bottom surface 155. In some embodiments, the second portion 165 is structured to form a protective plate or base to protect the fingers of a climber. In some embodiments, the first portion 160 is separate from the second portion 165. In other embodiments, the first portion 160 is integrally formed with the second portion 165. In yet other embodiments, the first portion 160 is configured to couple to the second portion 165. For example, in various embodiments, the first portion 160 is structured to reversibly engage with the second portion 165 to facilitate attaching and removing of each of the protruding elements 135.

In various embodiments, each of the protruding elements 135 is configured to couple to the glove 100 via one or more adhesives. In some embodiments, each of the protruding elements 135 is configured to couple to the glove 100 via riveting, stitching, and/or any other applicable method known in the art. In some embodiments, the protruding elements 135 are structured to permanently couple to the glove 100. In other embodiments, the protruding elements 135 are structured to removably couple to the glove 100.

Notwithstanding the embodiments described above in reference to FIGS. 1-5 various modifications and inclusions to those embodiments are contemplated and considered within the scope of the present disclosure.

It is also to be understood that the construction and arrangement of the elements of the systems and methods as shown in the representative embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter disclosed.

Accordingly, all such modifications are intended to be included within the scope of the present disclosure. Any means-plus-function clause is intended to cover the structures described herein as performing the recited function and not only structural equivalents but also equivalent structures. Other substitutions, modifications, changes, and omissions may be made in the design, operating conditions, and arrangement of the preferred and other illustrative embodiments without departing from scope of the present disclosure or from the scope of the appended claims.

Furthermore, functions and procedures described above may be performed by specialized equipment designed to perform the particular functions and procedures. The functions may also be performed by general-use equipment that executes commands related to the functions and procedures, or each function and procedure may be performed by a different piece of equipment with one piece of equipment serving as control or with a separate control device.

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Similarly, unless otherwise specified, the phrase "based on" should not be construed in a limiting manner and thus should be understood as "based at least in part on." Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances, where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B." Further, unless otherwise noted, the use of the words "approximate," "about," "around," "substantially," etc., mean plus or minus ten percent.

Moreover, although the figures show a specific order of method operations, the order of the operations may differ from what is depicted. Also, two or more operations may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection operations, processing operations, comparison operations, and decision operations.

The embodiments, illustratively described herein may suitably be practiced in the absence of any element or elements, limitation or limitations, not specifically disclosed herein. Thus, for example, the terms "comprising," "including," "containing," etc. shall be read expansively and without limitation. Additionally, the terms and expressions employed herein have been used as terms of description and not of limitation, and there is no intention in the use of such terms and expressions of excluding any equivalents of the features shown and described or portions thereof, but it is recognized that various modifications are possible within the scope of the claimed technology. Additionally, the phrase "consisting essentially of" will be understood to include those elements specifically recited and those additional elements that do not materially affect the basic and novel characteristics of the claimed technology. The phrase "consisting of" excludes any element not specified.

Other embodiments are set forth in the following claims.

What is claimed is:

1. A climbing glove comprising:

a palm portion; and a plurality of digit portions arranged adjacent to the palm portion, each of the plurality of digit portions comprising a plurality of segments;

wherein each of the plurality of digit portions comprises:

a plurality of protruding elements distributed among the plurality of segments, each of the plurality of protruding elements configured to engage with a surface of a tree, wherein:

a first protruding element of the plurality of protruding elements is disposed on a proximal phalange segment of the plurality of segments and has a first length and a first width wherein the first length is approximately ⅓ the first width;

a second protruding element of the plurality of elements is disposed on a middle phalange segment of the plurality of segments and has a second length and a second width, wherein the second length is approximately ½ the width of the second protruding element;

wherein each of the plurality of protruding elements extends from an outermost surface of the glove at an angle less than 90 degrees;

wherein at least one of a width or a length of each of the protruding elements is proportional to a corresponding length of a corresponding segment of the plurality of segments;

wherein a width of each of the protruding elements is approximately half a corresponding width of a corresponding digit portion; and wherein each of the plurality of protruding elements has a tetrahedral shape.

2. The climbing glove of claim 1, wherein each of the plurality of digit portions comprises at least a proximal phalange segment and a distal phalange segment, each of the proximal phalange segment and the distal phalange segment comprising at least one of the plurality of protruding elements.

3. The climbing glove of claim 2, wherein the plurality of digit portions comprises four finger portions and a thumb portion.

4. The climbing glove of claim 3, wherein each of the finger portions further comprises a middle phalange segment.

5. The climbing glove of claim 1, wherein each of the plurality of protruding elements comprises a first portion and a second portion, the first portion being disposed on a first surface of the glove and the second portion being disposed on a second surface of the glove, wherein the first surface is outward facing and the second surface is inward facing.

6. The climbing glove of claim 1, wherein the glove comprises natural fibers.

7. The climbing glove of claim 1, wherein the glove comprises synthetic fibers.

8. The climbing glove of claim 1, wherein the glove further comprises a wrist portion structured to encircle a wrist of a climber.

9. The climbing glove of claim 8, wherein the wrist portion comprises an elastic cuff.

10. A climbing glove comprising:

a palm portion; and a plurality of digit portions integrally formed with the palm portion, each of the plurality of digit portions comprising a plurality of segments, the plurality of segments having different lengths;

wherein each of the plurality of digit portions comprises a plurality of protruding elements distributed among the plurality of segments, wherein:

a first protruding element of the plurality of protruding elements is disposed on a proximal phalange segment of the plurality of segments and has a first length and a first width wherein the first length is approximately ⅓ the first width;

a second protruding element of the plurality of elements is disposed on a middle phalange segment of the plurality of segments and has a second length and a second width, wherein the second length is approximately ½ the width of the second protruding element;

wherein each of the plurality of protruding elements extends from an outermost surface of each digit portion at an angle and structured to engage with a surface of a tree, the angle being an acute angle;

wherein a length of each of the protruding elements is proportional to a corresponding length of a corresponding segment of the plurality of segments; and wherein a width of each of the protruding elements is approximately half a corresponding width of a corresponding digit portion.

11. The climbing glove of claim 10, wherein the width of each of the protruding elements is proportional to the width of the corresponding digit portion.

12. The climbing glove of claim 10, wherein the length of each of the protruding elements is proportional to the length of the corresponding digit portion.

13. The climbing glove of claim 10, wherein the width of each of the protruding elements is greater than the length of each of the protruding elements.

14. The climbing glove of claim 10, each of the protruding elements is tetrahedral in shape.

15. The climbing glove of claim 10, wherein the angle is based on a size of a phalange segment of the corresponding digit portion.

16. The climbing glove of claim 15, wherein the plurality of digit portions include four finger portions and one thumb portion, each of the finger portions including three phalange segments and the thumb portion including two phalange segments.

17. The climbing glove of claim 10, wherein each of the protruding elements comprises a first portion and a second portion, the first portion being disposed on the outermost surface of the glove, the second portion being disposed on an inward facing surface of the glove, the first portion being coupled to the second portion.

18. The climbing glove of claim 17, wherein the first portion and the second portion are integrally formed.

* * * * *